US010964277B1

(12) United States Patent
Hsu et al.

(10) Patent No.: US 10,964,277 B1
(45) Date of Patent: Mar. 30, 2021

(54) METHOD AND APPARATUS FOR DETERMINING AND CONTROLLING PERFORMANCE OF PRE-CHARGE OPERATIONS IN ELECTRONIC SHELF LABEL (ESL) SYSTEM

(71) Applicant: HIMAX TECHNOLOGIES LIMITED, Tainan (TW)

(72) Inventors: Kuang-Jung Hsu, Tainan (TW); Chih Hsu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/735,708

(22) Filed: Jan. 7, 2020

(51) Int. Cl.
*G09G 3/34* (2006.01)

(52) U.S. Cl.
CPC ..... *G09G 3/344* (2013.01); *G09G 2310/0248* (2013.01); *G09G 2330/024* (2013.01)

(58) Field of Classification Search
CPC ... G09G 2310/0248; G09G 2310/0251; G09G 2310/0254; G09G 2310/0272; G09G 2310/0275; G09G 3/30; G09G 3/32; G09G 3/3208; G09G 3/3216; G09G 3/3225; G09G 3/3433; G09G 3/344; G09G 3/36; G09G 3/3607; G09G 3/3614; G09G 3/3666
USPC ..... 345/76–83, 87–107
See application file for complete search history.

(56) References Cited

U.S. PATENT DOCUMENTS 10,529,298 B1 * 1/2020 Fujikawa ..... G09G 3/3696
2003/0053014 A1 * 3/2003 Niiyama ..... G09G 3/3629 349/106
2006/0163349 A1 * 7/2006 Neugebauer ..... G06Q 30/02 235/383
2006/0290638 A1 * 12/2006 Kang ..... G09G 3/3688 345/98
2007/0057875 A1 * 3/2007 Kwon ..... G09G 3/3216 345/76
2009/0219265 A1 * 9/2009 Lee ..... G09G 3/3291 345/205
2011/0102404 A1 * 5/2011 Hou ..... G09G 3/3614 345/211

(Continued)

FOREIGN PATENT DOCUMENTS

CN 101414452 A 4/2009
CN 106297643 A 1/2017

(Continued)

*Primary Examiner* — Alexander Eisen
*Assistant Examiner* — Nelson Lam
(74) *Attorney, Agent, or Firm* — Winston Hsu

(57) ABSTRACT

A method for determining and controlling performance of pre-charge operations of a plurality of source lines in an ESL system includes: obtaining voltage data of a plurality of lines of a frame to be displayed by a display module in the ESL system; determining whether pre-charge of the source lines in a rest period of a first line is required according to an amount of forthcoming voltage transitions to be generated on the source lines and accordingly obtaining a determination result; and controlling performance of pre-charge operations of the source lines in the rest period of the first line according to the determination result. When the amount of forthcoming voltage transitions to be generated on the source lines exceeds a predefined threshold, pre-charge of the source lines in the rest period of the first line is determined as required.

13 Claims, 5 Drawing Sheets

(56) References Cited

U.S. PATENT DOCUMENTS

| | | | | |
|---|---|---|---|---|
| 2013/0321385 | A1* | 12/2013 | Fujisawa | G09G 3/3216 345/212 |
| 2015/0255027 | A1 | 9/2015 | Wu | |
| 2015/0301778 | A1* | 10/2015 | Lim | G06K 19/07758 361/679.21 |
| 2016/0118002 | A1* | 4/2016 | Ito | G09G 3/3614 345/96 |
| 2017/0317511 | A1* | 11/2017 | Keysar | H02J 7/00308 |
| 2019/0066623 | A1 | 2/2019 | Zhao | |

FOREIGN PATENT DOCUMENTS

| | | | |
|---|---|---|---|
| CN | 110060622 | A | 7/2019 |
| JP | 2015-18064 | | 1/2015 |
| TW | 201432657 | A | 8/2014 |
| TW | 201510976 | A | 3/2015 |
| TW | 201913633 | A | 4/2019 |

* cited by examiner

METHOD AND APPARATUS FOR DETERMINING AND CONTROLLING PERFORMANCE OF PRE-CHARGE OPERATIONS IN ELECTRONIC SHELF LABEL (ESL) SYSTEM

BACKGROUND OF THE INVENTION

1. Field of the Invention

The present invention relates to automatic determination and control of pre-charge operations in an electronic shelf label (ESL) system, more particularly, to a method and an apparatus for automatically determining and controlling performance of the pre-charge operations on the source lines in the ESL system.

2. Description of the Prior Art

An electronic shelf label (ESL) system is used by retailers for displaying product pricing on shelves. The product pricing is automatically updated whenever a price is changed from a central control server. Typically, electronic display modules are attached to the front edge of retail shelving.

ESL modules use electronic paper (E-paper) or liquid-crystal display (LCD) to show the current product price to the customer. E-paper is widely used on ESLs as it provides crisp display and supports full graphic imaging. A communication network allows the price display to be automatically updated whenever a product price is changed. This communication network is what really makes ESL a viable solution. The wireless communication must support reasonable range, speed, battery life, and reliability. The means of wireless communication can be based on radio, infrared or even visible light communication.

A pre-charge scheme can be applied to the ESL system for saving the power consumption.

However, unnecessary pre-charge operations still induce power wasting. Therefore, a method and an apparatus for automatically and intelligently determining and controlling performance of the pre-charge operations for the ESL system are required.

SUMMARY OF THE INVENTION

With this in mind, it is one object of the present invention to provide a method and an apparatus for automatically and intelligently determining and controlling performance of the pre-charge operations on the source lines in the ESL system. The present invention determines whether pre-charge of the source lines is required according to an amount of forthcoming voltage transitions to be generated on the source lines and control performance of pre-charge operations of the source lines according to the determination result. Based on the proposed method and apparatus, whether to pre-charge the source lines or not is determined and controlled individually for each line. In this manner, the performance of pre-charge operations can be controlled more flexibly and intelligently, and the power wasting problem can be solved.

According to one embodiment, an apparatus for driving a display module of an ESL system is provided. The apparatus comprises: a source driver and a pre-charge determination circuit. The source driver is coupled to a plurality of source lines and arranged to provide a plurality of data signals onto the source lines. The pre-charge determination circuit is coupled to the source driver and arranged to determine whether pre-charge of the source lines in a rest period of a first line is required according to an amount of forthcoming voltage transitions to be generated on the source lines. When the amount of forthcoming voltage transitions to be generated on the source lines exceeds a predefined threshold, the pre-charge determination circuit determines that pre-charge of the source lines in the rest period of the first line is required.

According to one embodiment, a method for determining and controlling performance of pre-charge operations of a plurality of source lines in an ESL system is provided. The method comprises the step of: obtaining voltage data of a plurality of lines of a frame to be displayed by a display module in the ESL system; determining whether pre-charge of the source lines in a rest period of a first line is required according to an amount of forthcoming voltage transitions to be generated on the source lines and accordingly obtaining a determination result; and controlling performance of pre-charge operations of the source lines in the rest period of the first line according to the determination result, wherein when the amount of forthcoming voltage transitions to be generated on the source lines exceeds a predefined threshold, pre-charge of the source lines in the rest period of the first line is determined as required.

These and other objectives of the present invention will no doubt become obvious to those of ordinary skill in the art after reading the following detailed description of the preferred embodiment that is illustrated in the various figures and drawings.

DETAILED DESCRIPTION

In the following, numerous specific details are described to provide a thorough understanding of embodiments of the present invention. However, one of skilled in the art will understand how to implement the present invention in the absence of one or more specific details, or relying on other methods, elements or materials. In other instances, well-known structures, materials or operations are not shown or described in detail in order to avoid obscuring the main concepts of the present invention.

Reference throughout this specification to "one embodiment", "an embodiment", "one example" or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples.

Figure 1:
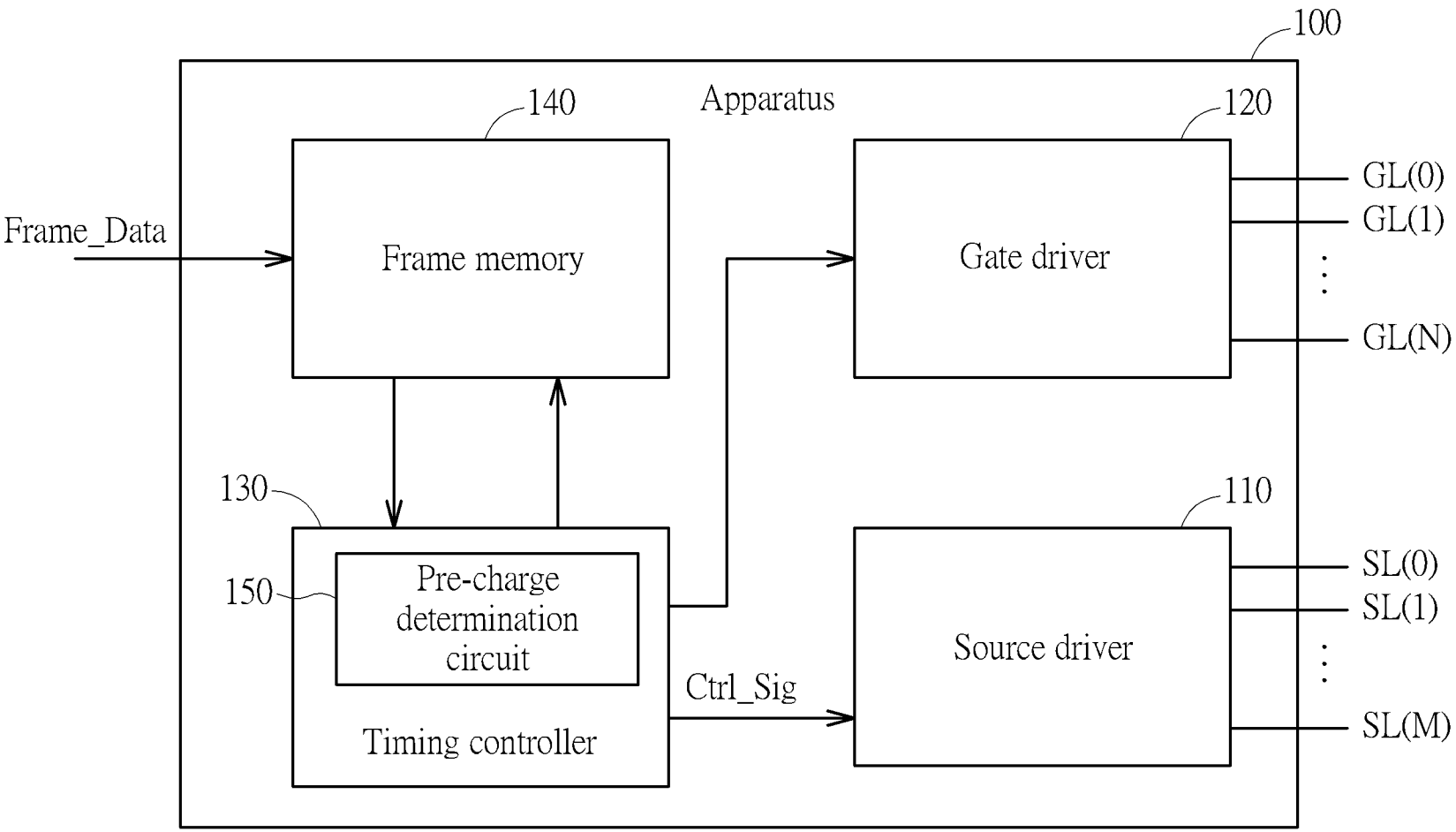
FIG. 1 is a diagram illustrating an apparatus for driving a display module of an ESL system according to an embodiment of the present invention.

FIG. 1 is a diagram illustrating an apparatus for driving a display module of an electronic shelf label (ESL) system according to an embodiment of the present invention. The apparatus 100 may at least comprise a source driver 110, a gate driver 120, a timing controller 130 and a frame memory 140.

The source driver 110 is a driving circuit coupled to a plurality of source lines, such as the SL(0), SL(1), . . . SL(M) shown in FIG. 1, and is arranged to provide a plurality of data signals onto the source lines. The data signals may carry voltage data of one or more frames to be displayed by a display module (not shown in FIG. 1) of the ESL system. In an embodiment of the present invention, M is a positive integer and is greater than 1.

The gate driver 120 is a driving circuit coupled to a plurality of gate lines, such as the GL(0), GL(1), . . . GL(N) shown in FIG. 1, and arranged to provide a plurality of scanning signals onto the gate lines. The scanning signals may carry one or more pulses for activating the pixel circuits (not shown in FIG. 1) coupled to the corresponding gate lines of the display module. In an embodiment of the present invention, N is a positive integer and is greater than 1.

The frame memory 140 may receive frame data Frame_Data to be displayed by the display module from an external image source (not shown in FIG. 1) and is arranged to buffer the received frame data Frame_Data.

The timing controller 130 is coupled to the source driver 110, the gate driver 120 and the frame memory 140. The timing controller 130 is arranged to control the timing of the scanning signals and the data signals, receive the frame data Frame_Data from the frame memory 140 and provide the corresponding data signals to the source driver 110 according to the frame data Frame_Data.

According to an embodiment of the present invention, the timing controller 130 may comprise a pre-charge determination circuit 150. The pre-charge determination circuit 150 is coupled to the source driver 110 and is arranged to determine whether pre-charge of the source lines (e.g. all or a portion of the source lines SL(0), SL(1), . . . SL(M)) in a rest period of a predetermined line is required according to an amount of forthcoming voltage transitions to be generated on the source lines (which will be discussed in more detailed in the following paragraphs).

In addition, according an embodiment of the present invention, the pre-charge determination circuit 150 is further arranged to transmit a control signal Ctrl_Sig to the source driver 110 to indicate whether pre-charge of the source lines in the rest period of a predetermined line is required. When the control signal Ctrl_Sig indicates that pre-charge of all or a portion of the source lines in the rest period of the predetermined line is required, the source driver 110 is arranged to set, control or drive the voltage of the corresponding source lines in the rest period of the predetermined line to a predetermined voltage, so that the corresponding source lines are pre-charged to the predetermined voltage in the rest period of the predetermined line.

According an embodiment of the present invention, the apparatus 100 may be implemented as a system-on-chip (SoC). In addition, according to an embodiment of the present invention, the display module may be implemented as an electronic paper (E-paper).

Figure 2:
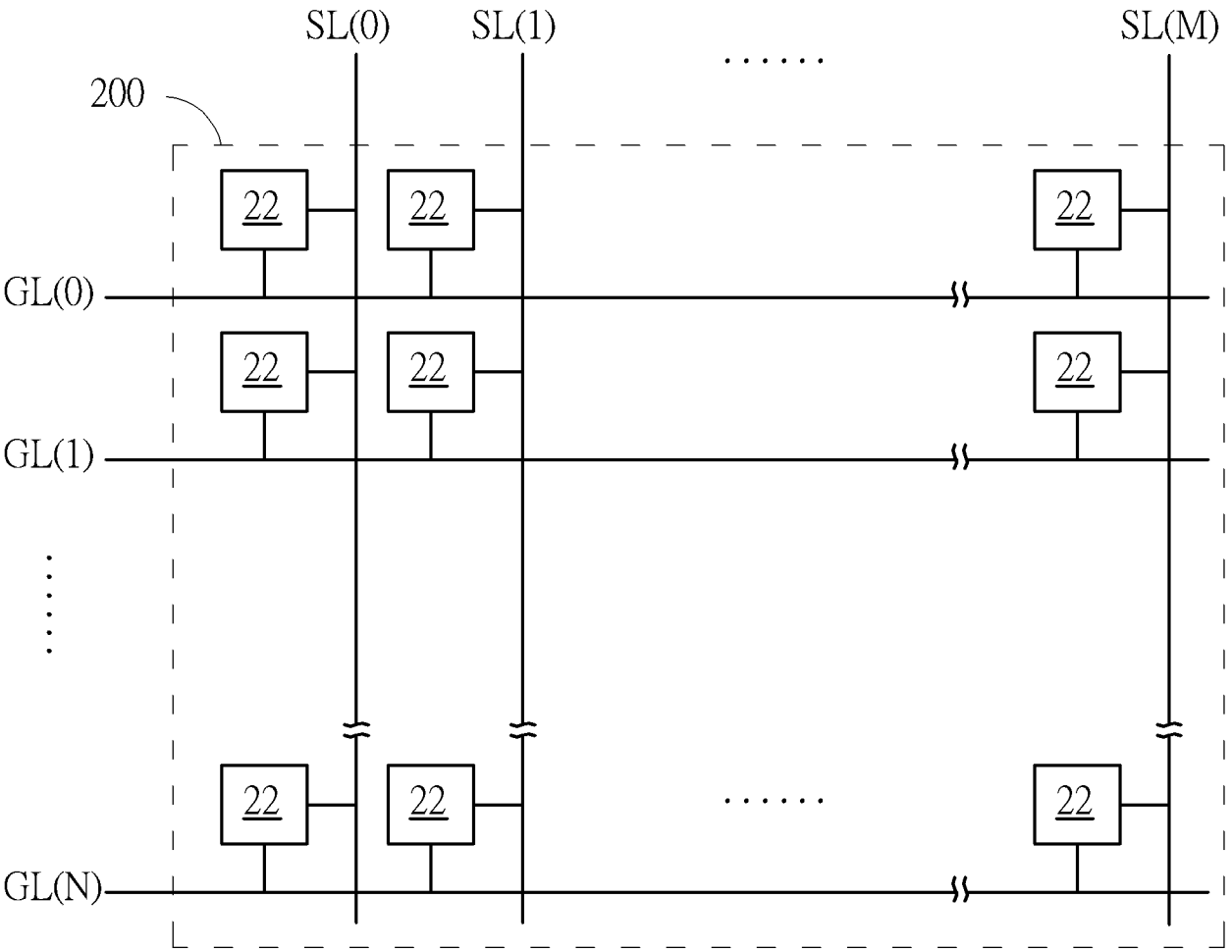
FIG. 2 is a simplified diagram illustrating an exemplary layout of the source lines and the gate lines coupled to a display module of the ESL system according to an embodiment of the present invention.

FIG. 2 is a simplified diagram illustrating an exemplary layout of the source lines and the gate lines coupled to a display module of the ESL system according to an embodiment of the present invention. In an embodiment of the present invention, the display module 200 may comprise a plurality of pixel circuits 22. Each pixel circuit 22 is located at an intersection of a source line and a gate line, and is coupled to the corresponding source line and gate line. According to an embodiment of the present invention, the pixel circuit 22 may comprise a plurality of microcapsules and a charging circuit. The charging circuit may comprise at least a switch element or a charging element, such as a Thin-Film Transistor (TFT), for charging the corresponding microcapsules. Each microcapsule may contain particles with different polarities. For example, each microcapsule may contain negatively charged white particles and positively charged black particles.

The display module 200 may comprise multiple rows of pixel circuits 22 which are aligned along the horizontal direction and the multiple rows of pixel circuits 22 are arranged along the vertical direction, so as to form a pixel matrix as shown in FIG. 2.

Typically, a frame may be formed with a plurality of lines, as an example, the lines extending along the horizontal direction. One line may correspond to one row of pixel circuits 22 of the display module 200, and a row of pixel circuits 22 may be arranged to display the image data of the corresponding line of the frame.

The gate line GL(n) coupled to a row of pixel circuits 22 is configured to transmit one or more pulses for activating or enabling the row of pixel circuits 22. Generally, the pulses may be sequentially provided on the gate lines GL(0), GL(1), . . . GL(N) in an non-overlapped manner or in a partially non-overlapped manner, so as to sequentially activate each row of pixel circuits 22.

When a row of pixel circuits 22 is activated (or, enabled), the data signals that have been programmed on the source lines SL(0), SL(1), . . . SL(M) can be provided to the corresponding pixel circuits 22, so that the pixel circuits 22 are charged according to voltage provided by the corresponding source lines. Typically, different voltages may correspond to the image data with different colors or gray levels. By applying different voltages, the particles of different colors will be attracted or moved to the top of the microcapsule that is close to the display surface, thereby outlining an image on screen.

Figure 3:
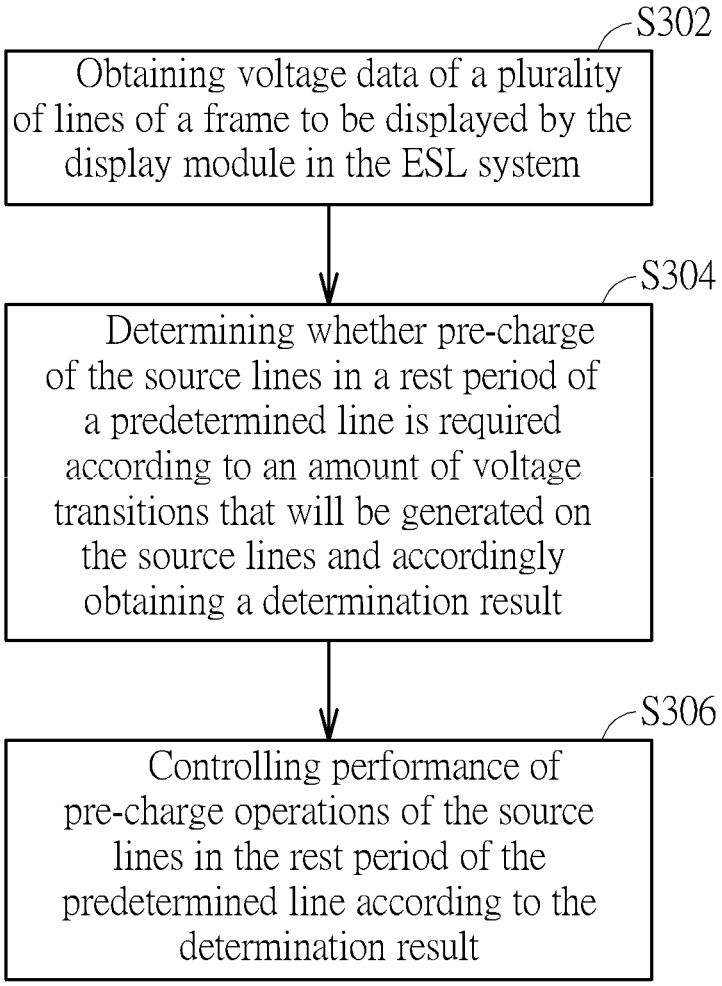
FIG. 3 is an exemplary flow chart illustrating a method for determining and controlling performance of pre-charge operations of a plurality of source lines in an ESL system according to an embodiment of the present invention.

FIG. 3 is an exemplary flow chart illustrating the method for determining and controlling performance of pre-charge operations of a plurality of source lines in an ESL system according to an embodiment of the present invention.

In Step S302, the pre-charge determination circuit 150 may obtain voltage data of a plurality of lines of a frame to be displayed by the display module in the ESL system. For example, the pre-charge determination circuit 150 may obtain voltage data of at least two lines of a frame to be displayed from the frame memory 140. It should be noted that the data processing at the timing controller 130 and the pre-charge determination circuit 150 may be at least one line ahead of the source driver 110. For example, the timing controller 130 and the pre-charge determination circuit 150 may be arranged to perform the corresponding data processing for a line Line(n) having a line index (n) while the source driver 110 is performing the corresponding data processing for a previous line Line(n−1) having a line index (n−1), where n is a positive integer.

In Step S304, the pre-charge determination circuit 150 may determine whether pre-charge of the source lines in a rest period of a predetermined line is required according to an amount of forthcoming voltage transitions to be generated on the source lines and accordingly obtain a determination result. In the embodiments of the invention, the forthcoming voltage transition to be generated on the source lines means the voltage transition that is determined as will be generated on the source lines in the future.

In Step S306, the pre-charge determination circuit 150 may control performance of pre-charge operations of the source lines in the rest period of the predetermined line according to the determination result.

According to an embodiment of the present invention, when the amount of forthcoming voltage transitions to be generated on the source lines exceeds a predefined threshold, pre-charge of the source lines in the rest period of the predetermined line is determined as required.

The determination of whether pre-charge of the source lines is required and the control of the pre-charge operations may be repeatedly and individually performed for different lines of a frame according to the voltage data of the corresponding lines.

According to an embodiment of the present invention, the predefined threshold may be determined according to a number of source lines to be controlled. For example, the predefined threshold may be set to a value as a half or close to a half of the number of source lines to be controlled.

Figure 4:
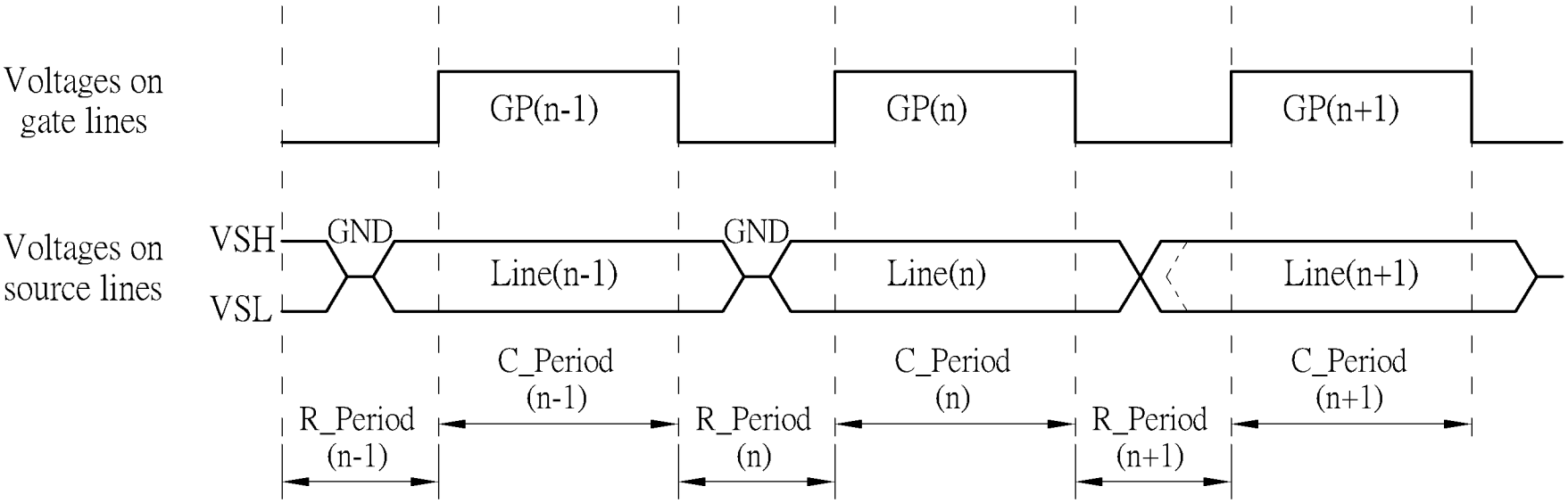
FIG. 4 is an exemplary timing diagram showing the voltages on the gate lines and the voltages on the source lines according to an embodiment of the present invention.

For better comprehension, FIG. 4 is an exemplary timing diagram showing the voltages on the gate lines and the voltages on the source lines according to an embodiment of the present invention, where in FIG. 4, n is a positive integer and is smaller than the total number of lines comprised in one frame.

As discussed above, the source lines, such as the SL(0), SL(1), . . . SL(M) shown in FIG. 1, may be programmed with voltages in different levels, so as to display different colors. The programmable voltages may comprise a positive voltage VSH and a negative voltage VSL, where the positive voltage VSH may be a first steady state voltage for displaying a first color (e.g. the white or block color) and the negative voltage VSL may be a second steady state voltage for displaying a second color(e.g. the block or white color). When the pulse GP(n−1) arrives on the corresponding gate line GL(n−1) (that is, when the voltage on the gate line GL(n−1) is pulled high to a logic high level), the pixel circuits coupled to gate line GL(n−1) are activated and the voltages, which have already been programmed or applied to the corresponding output multiplexers configured for different source lines according to the voltage data of the line (n−1), are provided to the corresponding pixel circuits 22 for charging the pixel circuits 22. Similarly, when the pulse GP(n) arrives on the corresponding gate line GL(n), the pixel circuits coupled to gate line GL(n) are activated and the voltages, which have already been programmed or applied to different source lines according to the voltage data of the line (n), are provided to the corresponding pixel circuits 22 for charging the pixel circuits 22. Similar operations are repeated for gate line GL(n+1)/Line (n+1), GL(n+2)/Line (n+2), and so on.

It should be noted that since the source lines, such as the source lines SL(0), SL(1), . . . SL(M) shown in FIG. 1, may be programmed with the positive voltage VSH or the negative voltage VSL depending on the content of the image data, the waveform of the voltages on the source lines shown in FIG. 4 will not be set to any specific level during the charge periods, and the waveform is utilized to represent the voltages on all source lines to be controlled.

According to an embodiment of the present invention, before applying or programming the voltage of the image data to the source lines, the source driver 110 may selectively set, control or drive the voltages on the source lines to a predetermined voltage level, such as the ground voltage, based on the determination result indicated by the pre-charge determination circuit 150.

When the source driver 110 sets the voltages on the source lines to a predetermined voltage level in response to the control signal Ctrl_Sig received from the pre-charge determination circuit 150, the voltages on the source lines will be temporarily set to the predetermined voltage level during a rest period R_Period of the corresponding line. According to an embodiment of the present invention, a rest period R_Period(n) of a line (n) occurs earlier than a charge period C_Period(n) of the line (n) and comes after a charge period C_Period(n−1) of the line (n−1). As shown in FIG. 4, the rest period R_Period(n) of line (n) comes after the charge period C_Period(n−1) of line (n−1) and the charge period C_Period (n) of line (n) comes after the rest period R_Period(n) of line (n). Similarly, the rest period R_Period(n+1) of line (n+1) comes after the charge period C_Period(n) of line (n) and the charge period C_Period(n+1) of line (n+1) comes after the rest period R_Period (n+1) of line (n+1).

As shown in FIG. 4, in the beginning of the rest period R_Period (n) of the line (n), the data voltages of a previous line (n−1) are kept on the source lines. This is because that it takes some time for a gate pulse GP(n) output from the gate driver 120 to be transmitted to the last pixel circuit 22 coupled to the corresponding gate line GL(n). Therefore, for the last pixel circuit 22 to have enough time to receive the gate pulse GP(n) and the data voltage, the voltage applied on the source lines should be still kept for some period of time even after the gate pulse GP(n) is ended (that is, when the voltage on the corresponding gate line GL(n) is pulled low to a logic low level).

In addition, as shown in FIG. 4, since the voltages on the source lines should be stable when charging the pixel circuits 22, the data voltages of line (n) should have been already programmed on the source lines before the corresponding gate pulse GP(n) arrives.

In the exemplary scenario shown in FIG. 4, the pre-charge determination circuit 150 determines that pre-charge of the source lines in the rest period of line (n−1) is required, and the voltages on the source lines are pre-charged to a predetermined voltage, such a ground voltage GND, in the rest period of line (n−1), where the line (n−1) is a line having a line index (n−1) and corresponds to the gate line GL(n−1) having a gate line index (n−1) as discussed above. The voltages on the source lines are pre-charged to the predetermined voltage for a short period of time. After that, the data voltages of line (n−1) are programmed on the source lines before the corresponding gate pulse GP(n−1) arrives.

Similarly, since the pre-charge determination circuit 150 determines that pre-charge of the source lines in the rest period of line (n) is required, the voltages on the source lines are pre-charged to a predetermined voltage, such the ground voltage GND, in the rest period of line (n), where the line (n) is a line having a line index (n) and corresponds to the gate line GL(n) having a gate line index (n) as discussed above. After that, the data voltages of line (n) are programmed on the source lines before the corresponding gate pulse GP(n) arrives.

Different from line (n−1) and line (n), for line (n+1), the pre-charge determination circuit 150 determines that pre-charge of the source lines in the rest period of line (n+1) is not required. In this manner, the voltages on the source lines are not pre-charged to any predetermined voltage. That is, the voltages on the source lines may be kept the same as the previously programed values before the source driver 110 programs the data voltages of line(n+1) on the source lines.

As discussed above, the determination of whether pre-charge of the source lines is required and the control of the pre-charge operations may be repeatedly and individually performed for different lines of a frame according to the voltage data of the corresponding lines. When the amount of forthcoming voltage transitions that will be generated on the source lines exceeds a predefined threshold, the pre-charge determination circuit 150 determines that pre-charge of the source lines in the rest period of the predetermined line is required.

According to an embodiment of the present invention, the voltage transition may be a transition passing through a first voltage, and when pre-charge of the source lines in the rest period of the predetermined line is determined as required, the source lines are pre-charged to the first voltage in the rest period of the predetermined line. The first voltage may be, as an example but not limited to, the ground voltage.

According to another embodiment of the present invention, the voltage transition is a transition from a first steady state voltage (such as the positive voltage VSH) to a second steady state voltage (such as the negative voltage VSL) or from a second steady state voltage to a first steady state voltage, and when pre-charge of the source lines in the rest period of the predetermined line is determined as required, the source lines are pre-charged to the ground voltage in the rest period of the predetermined line. Note that as discussed above, the first/second steady state voltage are the voltages applied to the pixel circuits for displaying the first/second color.

Figure 5A:
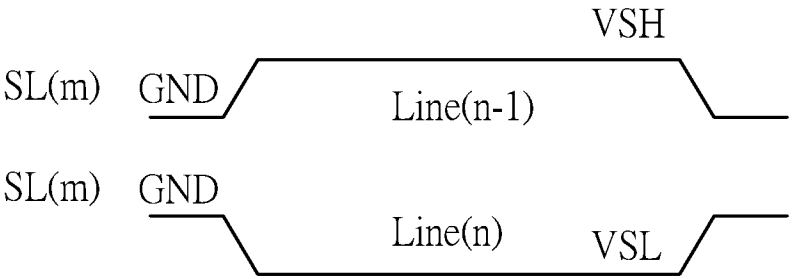
FIG. 5A-FIG. 5D are schematic diagrams showing the exemplary voltages on the source lines according to an embodiment of the present invention.

FIG. 5A-FIG. 5D are schematic diagrams showing the exemplary voltages on the source lines according to an embodiment of the present invention. In FIG. 5A, the voltages to be programmed on the source line SL(m) for line (n−1) and line (n) are shown. According to an embodiment of the present invention, whether the voltage transition will be generated on a source line may be determined according to change or difference of the voltage on the source line between a charge period of a second line and a charge period of a first line, where the first line may have a line index (n) and correspond a gate line having a gate line index (n) and the second line may have a line index (n−1) and correspond to a previous gate line having a gate line index (n−1).

For the case shown in FIG. 5A, the voltage of the source line SL(m) will be charged to the positive voltage VSH to provide the corresponding image data for line (n−1) and then charged to the negative voltage VSL to provide the corresponding image data for line (n). In this manner, the pre-charge determination circuit 150 determines that voltage transition will be generated on source line SL(m) when charging the source line SL(m) according to the image data of line (n).

Figure 5B:
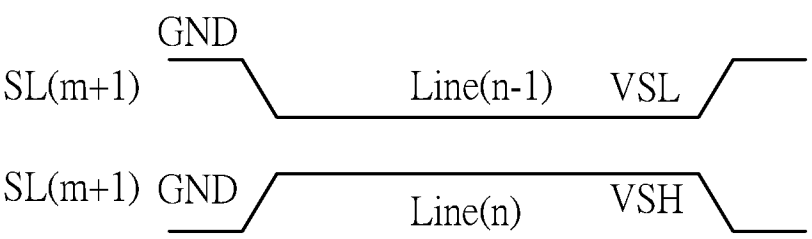

For the case shown in FIG. 5B, the voltage of the source line SL(m+1) will be charged to the negative voltage VSL to provide the corresponding image data for line (n−1) and then charged to the positive voltage VSH to provide the corresponding image data for line (n). In this manner, the pre-charge determination circuit 150 determines that voltage transition will be generated on source line SL(m+1) when charging the source line SL(m+1) according to the image data of line (n).

Figure 5C:
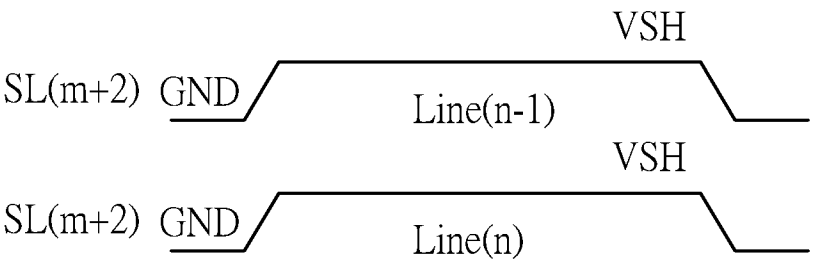

For the case shown in FIG. 5C, the voltage of the source line SL(m+2) will be charged to the positive voltage VSH to provide the corresponding image data for line (n−1) and then also charged to the positive voltage VSH to provide the corresponding image data for line (n). In this manner, the pre-charge determination circuit 150 determines that voltage transition will not be generated on source line SL(m+2) when charging the source line SL(m+2) according to the image data of line (n).

Figure 5D:
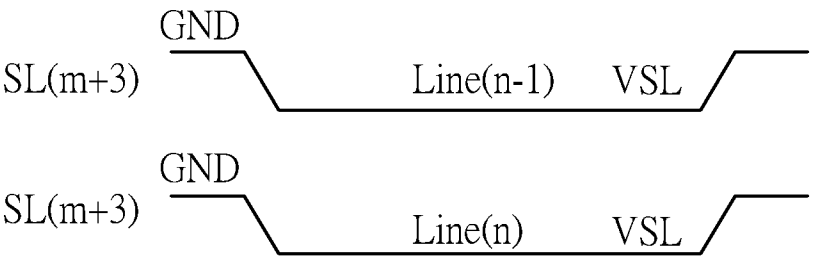

For the case shown in FIG. 5D, the voltage of the source line SL(m+3) will be charged to the negative voltage VSL to provide the corresponding image data for line (n−1) and then also charged to the negative voltage VSL to provide the corresponding image data for line (n). In this manner, the pre-charge determination circuit 150 determines that voltage transition will not be generated on source line SL(m+3) when charging the source line SL(m+3) according to the image data of line (n).

In the embodiment shown in FIG. 5A-FIG. 5D, since two source lines will have voltage transition generated thereon, the pre-charge determination circuit 150 determines that the amount of forthcoming voltage transitions to be generated on these four source lines SL(m) SL(m+3) is 2.

Note that the number of source lines shown in FIG. 5A-FIG. 5D is just an example to illustrate how to determine the amount of forthcoming voltage transitions to be generated on the source lines, and the invention should not be limited thereto.

In the embodiments of the present invention, the pre-charge determination circuit 150 may take all the source lines comprised in the ESL system as a whole and make the pre-charge determination and control for the whole source lines together, or may divide the source lines into several groups and individually make the pre-charge determination and control for each group.

According to a first embodiment of the present invention, the pre-charge determination circuit 150 may take all of the source lines SL(0)~SL(M) as a group for calculating the forthcoming amount of voltage transitions to be generated on the source lines and then control performance of pre-charge operations of all source lines SL(0)~SL(M) in the rest period of a predetermined line according to the determination result.

Suppose that the source driver 110 is coupled to a first number of source lines, and the pre-charge determination circuit 150 determines whether pre-charge of the source lines is required for a second number of source lines. In the first embodiment of the present invention, the first number is equal to the second number. As an example, in the embodiment shown in FIG. 1, the first number is (M+1)).

To be more specific, in the first embodiment of the present invention, the pre-charge determination circuit 150 may calculate how many source lines among the (M+1) source lines will have a predefined voltage transition (for example, a transition from a first steady state voltage to a second steady state voltage or from a second steady state voltage to a first steady state voltage as discussed above) generated thereon when being programmed with the corresponding voltage of a predetermined line (n), and determine whether pre-charge of the (M+1) source lines in a rest period of the predetermined line (n) is required based on the calculation result.

If the calculation result exceeds the predefined threshold (for example but not limited to, the predefined threshold may be set to (m+1)/2), the pre-charge determination circuit 150 determines that pre-charge of the (M+1) source lines in a rest period of the predetermined line (n) is required. Otherwise, the pre-charge determination circuit 150 determines that pre-charge of the (M+1) source lines in a rest period of the predetermined line (n) is not required.

When the pre-charge determination circuit 150 determines that pre-charge of the (M+1) source lines in a rest period of the predetermined line (n) is required, the (M+1) source lines will all be pre-charged to a predetermined voltage in the rest period of the predetermined line (n).

When the pre-charge determination circuit 150 determines that pre-charge of the (M+1) source lines in a rest period of the predetermined line (n) is not required, the (M+1) source lines will not be pre-charged to the predetermined voltage in the rest period of the predetermined line (n).

According to a second embodiment of the present invention, the pre-charge determination circuit 150 may divide the source lines SL(0)~SL(M) into several groups, calculate, for each group, how many source lines among all the source lines comprised in the corresponding group will have a predefined voltage transition generated thereon when being programmed with the corresponding voltage of a predetermined line (n), and determine, for each group, whether pre-charge of the source lines comprised in the corresponding group in a rest period of the predetermined line (n) is required based on the calculation result.

Then, the pre-charge determination circuit 150 may individually control performance of pre-charge operations of the corresponding source lines in the rest period of a predetermined line (n) according to the determination result obtained for each group. That is, the pre-charge determination circuit 150 may individually control performance of the pre-charge of the source lines belong to different groups according to determination result obtained for the corresponding group.

Suppose that the source driver 110 is coupled to a first number of source lines, and the pre-charge determination circuit 150 determines whether pre-charge of the source lines is required for a second number of source lines in a group. In the second embodiment of the present invention, the second number is smaller than the first number.

For example, suppose that the pre-charge determination circuit 150 divides the source lines SL(0)~SL(M) into two groups, where SL(0)~SL(m) belong to the first group and SL(m+1)~SL(M) belong to the second group, and m is a positive integer smaller than M. The pre-charge determination circuit 150 then calculates how many source lines in the first group will have a predefined voltage transition generated thereon when being programmed with the corresponding voltage of a predetermined line (n), and determine whether pre-charge of the first group source lines in a rest period of the predetermined line (n) is required based on the calculation result. The pre-charge determination circuit 150 also calculates how many source lines in the second group will have the predefined voltage transition generated thereon when being programmed with the corresponding voltage of the predetermined line (n), and determine whether pre-charge of second group source lines in the rest period of the predetermined line (n) is required based on the calculation result.

When the pre-charge determination circuit 150 determines that pre-charge of the first group source lines in the rest period of the predetermined line (n) is required, the source lines belong to the first group will all be pre-charged to a predetermined voltage in the rest period of the predetermined line (n).

When the pre-charge determination circuit 150 determines that pre-charge of the second group source lines in the rest period of the predetermined line (n) is not required, the source lines belong to the second group will not be pre-charged to the predetermined voltage in the rest period of the predetermined line (n).

Therefore, for the same line of a frame, in the second embodiment of the invention, the pre-charge of the source lines belong to different groups may be determined and controlled differently and independently.

It should be noted that in the conventional design, the pre-charge determination is not implemented. Whether to pre-charge the source lines or not will be all controlled by a value stored in a register. Based on the value of the register, if the pre-charge function is enabled, all the source lines comprised in the system will be pre-charged, and the pre-charge operations will be performed for all lines of the frames. If the pre-charge function is disabled, all the source lines comprised in the system will not be pre-charged. Therefore, in the conventional design, the pre-charge operations for all lines are collectively controlled based on the value of the register. For the case where there is nearly no voltage transitions on the sources lines, if the pre-charge function is enabled, the unnecessary pre-charge operations will induce huge power wasting.

Different from the conventional design, in the proposed method and apparatus, whether to pre-charge the source lines or not will be determined and controlled individually for each line. The pre-charge determination circuit 150 may automatically perform the pre-charge determination and control one by one for each line to be displayed according to the corresponding data voltages.

Therefore, the pre-charge operation will be performed only when it is required. For example, the pre-charge operation will be performed only when voltage transitions are going be generated on a major number of source lines among all the source lines to be controlled. In this manner, the performance of pre-charge operations can be controlled more flexibly and intelligently, and the power wasting problem can be solved.

Embodiments of the present invention can be implemented using hardware, software, firmware, and/or combinations thereof. Through an appropriate instruction execution system, embodiments of the present invention can be implemented using software or firmware stored in a memory. In terms of hardware, embodiments of the present invention can be implemented using any of the following technologies or a combination thereof: a separate logic having a logic gate capable of performing a logic function according to a data signal, and an application specific integrated circuit (ASIC), a programmable gate array (PGA), or a field programmable gate array (FPGA) having suitable combinational logics.

Flowcharts and block diagrams in the flow diagrams illustrate the architecture, functionality, and operation of possible implementations of systems, methods, and computer program products according to various embodiments of the present embodiments. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus for driving a display module of an electronic shelf label (ESL) system, comprising:

a source driver, coupled to a plurality of source lines and arranged to provide a plurality of data signals onto the source lines; and a pre-charge determination circuit, coupled to the source driver and arranged to determine whether pre-charge of the source lines in a rest period of a first line is required according to an amount of forthcoming voltage transitions to be generated on the source lines, wherein when the amount of forthcoming voltage transitions to be generated on the source lines exceeds a predefined threshold, the pre-charge determination circuit determines that pre-charge of the source lines in the rest period of the first line is required, and wherein the voltage transition is a transition from a first steady state voltage for displaying a first color to a second steady state voltage for displaying a second color or from the second steady state voltage for displaying the second color to the first steady state voltage for displaying the first color, and when pre-charge of the source lines in the rest period of the first line is determined as required, the source lines are pre-charged to a ground voltage in the rest period of the first line.

2. The apparatus of claim 1, wherein the pre-charge determination circuit is further arranged to transmit a control signal to the source driver to indicate whether pre-charge of the source lines in the rest period of the first line is required.

3. The apparatus of claim 1, further comprising:

a gate driver, coupled to a plurality of gate lines and arranged to provide a plurality of scanning signals onto the gate lines, wherein the first line corresponds to a gate line having a gate line index n, n is a positive integer, the amount of forthcoming voltage transitions to be generated on the source lines is determined according to changes of voltages on the source lines between a charge period of a second line and a charge period of the first line, and the second line corresponds to a gate line having a gate line index (n−1).

4. The apparatus of claim 3, wherein the rest period of the first line comes after the charge period of the second line and the charge period of the first line comes after the rest period of the first line.

5. The apparatus of claim 1, wherein the data signals carry voltage data of a plurality of lines of a frame to be displayed by the display module, and the determination of whether pre-charge of the source lines is required is repeatedly performed according to the voltage data of the lines.

6. The apparatus of claim 1, wherein the source driver is coupled to a first number of source lines and the pre-charge determination circuit determines whether pre-charge of the source lines is required for a second number of source lines, and the second number is equal to or smaller than the first number.

7. The apparatus of claim 1, wherein the source lines are divided into a plurality of groups, the pre-charge determination circuit is further arranged to determine, for each group, whether pre-charge of the source lines comprised in the corresponding group in the rest period of the first line is required according to an amount of forthcoming voltage transitions to be generated on the source lines comprised in the corresponding group, and individually control performance of the pre-charge of the source lines belong to different groups according to determination result obtained for the corresponding group.

8. A method for determining and controlling performance of pre-charge operations of a plurality of source lines in an electronic shelf label (ESL) system, comprising:

obtaining voltage data of a plurality of lines of a frame to be displayed by a display module in the ESL system;

determining whether pre-charge of the source lines in a rest period of a first line is required according to an amount of forthcoming voltage transitions to be generated on the source lines and accordingly obtaining a determination result; and controlling performance of pre-charge operations of the source lines in the rest period of the first line according to the determination result, wherein when the amount of forthcoming voltage transitions to be generated on the source lines exceeds a predefined threshold, pre-charge of the source lines in the rest period of the first line is determined as required, and wherein the voltage transition is a transition from a first steady state voltage for displaying a first color to a second steady state voltage for displaying a second color or from the second steady state voltage for displaying the second color to the first steady state voltage for displaying the first color, and when pre-charge of the source lines in the rest period of the first line is determined as required, the source lines are pre-charged to a ground voltage in the rest period of the first line.

9. The method of claim 8, wherein the first line has a line index n, n is a positive integer, and a step of determining whether pre-charge of the source lines in the rest period of the first line is required according to an amount of forthcoming voltage transitions to be generated on the source lines further comprises:

determining changes of voltages on the source lines between a charge period of a second line and a charge period of the first line according to the voltage data of the first line and the voltage data of the second line, wherein the second line has a line index (n−1).

10. The method of claim 9, wherein the rest period of the first line comes after the charge period of the second line and the charge period of the first line comes after the rest period of the first line.

11. The method of claim 8, wherein a step of determining whether pre-charge of the source lines in the rest period of the first line is required is repeatedly performed for different lines of the frame.

12. The method of claim 8, wherein the ESL system comprises a first number of source lines and a step of determining whether pre-charge of the source lines in the rest period of the first line is required is performed for a second number of source lines, and the second number is equal to or smaller than the first number.

13. The method of claim 8, wherein the source lines are divided into a plurality of groups, steps of determining whether pre-charge of the source lines in the rest period of the first line is required according to the amount of forthcoming voltage transitions to be generated on the source lines and accordingly obtaining the determination result and controlling performance of pre-charge operations of the source lines in the rest period of the first line according to the determination result are performed for the source lines belong to different groups independently.

* * * * *